US005667404A

United States Patent [19]

Kato et al.

[11] Patent Number: 5,667,404

[45] Date of Patent: Sep. 16, 1997

[54] CO-AXIAL CONNECTOR FOR HIGH-FREQUENCY CABLE

[75] Inventors: Tatsuo Kato, Tokyo; Akihiko Ono, Kitaibaraki, both of Japan

[73] Assignee: SMK Corp., Tokyo, Japan

[21] Appl. No.: 509,934

[22] Filed: Aug. 1, 1995

[30] Foreign Application Priority Data

Aug. 4, 1994 [JP] Japan ..... 6-201535

[51] Int. Cl.[6] ..... H01R 9/05

[52] U.S. Cl. ..... 439/578; 439/746; 439/748

[58] Field of Search ..... 439/578–585, 439/675, 743–747, 595, 748

[56] References Cited

U.S. PATENT DOCUMENTS

| | | | |
|---|---|---|---|
| 4,060,303 | 11/1977 | Wilczynski | 439/622 |
| 4,995,836 | 2/1991 | Toramoto | 439/578 |
| 5,061,207 | 10/1991 | Wright | 439/578 |

FOREIGN PATENT DOCUMENTS

| | | | |
|---|---|---|---|
| 03216977 | 9/1991 | Japan | 439/578 |

*Primary Examiner*—David L. Pirlot

*Attorney, Agent, or Firm*—Armstrong, Westerman, Hattori, McLeland & Naughton

[57] ABSTRACT

The present invention provides a co-axial connector for a high frequency cable which includes a slit in the earth metal fittings. The slit enables the earth metal fittings to be widened and allows insertion of an insulating bushing into the earth metal fittings. After insertion, the slit returns to its home position by the spring tension of the earth metal fittings and retains the insulating bushing by spring tension. This configuration makes assembly easier. Furthermore, after the insertion of the insulating bushing into the earth metal fitting, a shielding cylinder is engaged with the earth metal fittings in order to cover the rear end of the earth metal fittings. This configuration prevents high-frequency signals from leaking, and does not require the widening of the slit, while connected to the other connectors, which loosens the engagement between the earth metal fittings and the insulating bushing. Consequently, this configuration of the present invention prevents the insulating bushing from slipping off.

4 Claims, 4 Drawing Sheets

CO-AXIAL CONNECTOR FOR HIGH-FREQUENCY CABLE

FIELD OF THE INVENTION

The present invention relates generally to co-axial cables and more particularly, to a co-axial connector for a high-frequency cable.

BACKGROUND OF THE INVENTION

Referring to FIG. 7, a prior art co-axial connector for a high-frequency cable 101 is provided with a center pin 104 which is connected electrically to a central conductor 103 of a co-axial cable 102. The center pin 104 is supported in the center of a molding insulator 105. An external terminal 106 is engaged with the periphery of the molding insulator 105. The external terminal 106 is connected electrically to an external conductor 107 of the co-axial cable 102 by a connecting piece 108, and supported mechanically on a plastic sheath 109 of the co-axial cable 102 by an anchoring piece 110. The external terminal 106 is provided with a longitudinal slit 111 until about the middle of the terminal in order to gain spring tension. A mold-insulating bushing 112 is provided on the periphery of the external terminal 106.

The prior art co-axial connector for high-frequency cable has the problem of requiring an accurate outer diameter for the molding insulator 105 because the molding insulator 105 engages the cylinder of the external terminal 106. The engagement of the molding insulator 105 and the external terminal 106 has created other problems in addition to the assembly problems already existing.

Furthermore, when the molding insulator 105 engages an engaging projection provided on the molding insulator 105, the engaging projection is attached to the end of an external terminal 106 during assembly. The attachment of the engaging projection to the external terminal 106 results in damage of the engaging projection and deformation of the external terminal 106.

Another structure was proposed to prevent the damage to projection and the deformation of the external terminal 106. This alternate structure included a slit provided axially to the cylinder of the external terminal 106 in order to adjust the inner diameter of the cylinder. However, the co-axial connector for a high-frequency cable with the alternate structure resulted in leakage of high frequency signals through the slit. Furthermore, the slit widened while in connection with another connector, causing a release of its engagement with the molding insulator so that the molding insulator slipped off the cylinder.

An object of the present invention is to provide a co-axial connector for a high-frequency cable which is convenient to assemble, which prevents high-frequency signals from leaking and which protects the molding insulator 105 from slipping off the external terminal 106.

Another object of the present invention is to provide a co-axial connector for a high frequency cable which protects an insulating bushing from slipping off earth metal fittings.

SUMMARY OF THE INVENTION

The co-axial connector for a high-frequency cable of the present invention includes a center pin connected to a central conductor of a co-axial cable. An insulating bushing is to be inserted into and to support the center pin. Earth metal fittings having a cylindrical part which engages and supports the insulating bushing and the cylindrical part has an axial slit which is widened due to engagement with said insulating bushing supporting said center pin. A barrel part is connected to a rear portion of the earth metal fittings and an external conductor is secured to the co-axial cable, preferably by caulking, or else by soldering. A molding cover is located on the periphery of the earth metal fittings. A shielding cylinder having a large diametric part and a small diametric part is located between the molding cover and the earth metal fittings such that the large diametric part covers the rear of the axial slit of the cylindrical part and fastens the cylindrical part centripetally. The small diametric part covers the barrel part.

The co-axial connector for a high frequency cable of the present invention is provided with an axial slit to the cylindrical part of earth metal fittings, wherein the slit is widened to engage with an insulating bushing. Therefore the invention has the advantage of making assembly easier. Furthermore, a shielding cylinder, which includes large and small diametric parts is provided between a molding cover and earth metal fittings. The large diametric part covers the rear of the slit and binds the cylindrical part centripetally. The small diametric part covers the barrel part of the earth metal fittings. This allows the present invention to have the advantage of preventing the earth metal fittings from widening during use and preventing the insulating bushing from slipping off. Thus, the connector is not broken, and high-frequency signals are prevented from leaking.

The small diametric part of the shielding cylinder is caulked and electrically connected to the barrel part. Further, bosses are provided on either of the contact-surfaces between the shielding cylinder and the earth metallic fittings. This allows therefore the present invention the advantage of a rigid fixation between the earth metal fittings and the shielding cylinder, and it improves electric connection as well.

The engaging projection provided on the insulating bushing and the square hole provided on the middle part of the slit each contribute to the rigid engagement of the insulating bushing with the earth metal fittings. Even if the slit may widen slightly while connected to the other connectors, the insulating bushing will not slip off the earth metal fittings.

When the insulating bushing is being inserted into the earth metal fittings, there is only enough room to insert the insulating bushing until an engaging projection is engaged with the square hole. Therefore, it is easier to index the insulating bushing to the earth metal fittings.

BRIEF DESCRIPTION OF THE DRAWING FIGURES

DETAILED DESCRIPTION OF THE INVENTION

Figure 1:
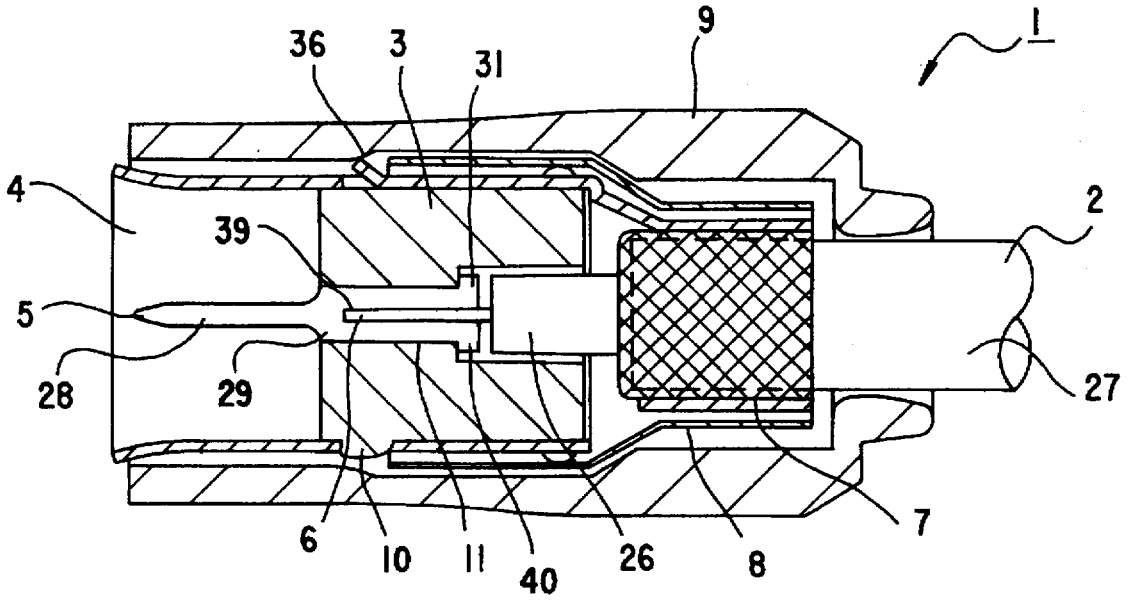
FIG. 1 is a sectional view of the co-axial connector for a high frequency cable of the present invention.

The preferred embodiment of the present invention is illustrated in FIGS. 1–6. Referring to FIG. 1, the co-axial connector for a high frequency cable of the present invention is shown. FIG. 1 shows a co-axial cable 2, an insulating bushing 3, earth metal fittings 4, a center pin 5, a shielding cylinder 8 and a molding cover 9. The co-axial cable 2 includes a central conductor 6, an inner insulator 26, an external conductor 7, and an external insulator 27.

The center pin 5 includes a needlelike joint 28, a cylindrical supporter 29 and a flange 31. The cylindrical supporter 29 is connected to the rear of the joint 28 and has a larger diameter than the diameter of the joint. The flange 31 is provided on the rear end of the cylindrical supporter 29. An inserter slot 39 of the central conductor 6 is splined along the axis from the rear of the center pin 5.

The insulating bushing 3 is cylindrical and an engaging projection 10 is provided on the periphery of the insulating bushing 3. An insertion slot 11 of the center pin 5 is splined through the insulating bushing 3. The insertion slot 11 of the center pin 5 has steps 40.

Figure 2:
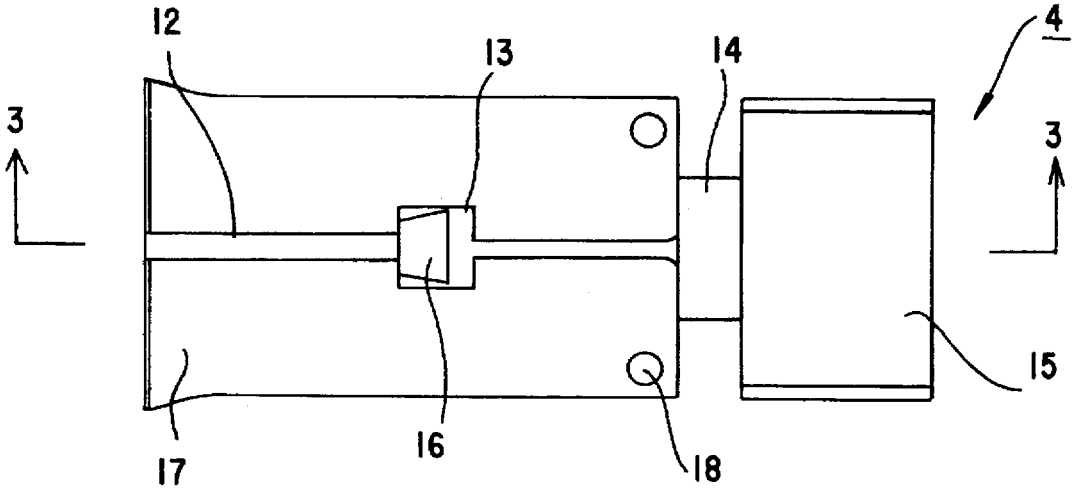
FIG. 2 is a bottom view of the earth metal fittings of the present invention.
Figure 3:
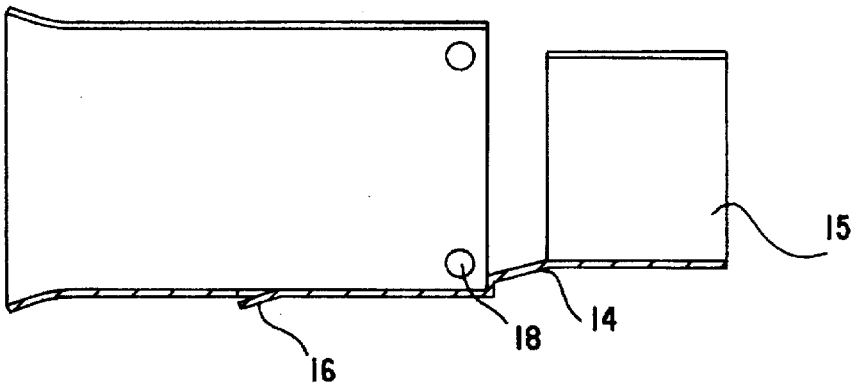
FIG. 3 is a sectional view taken along the line 3—3 in FIG. 2.

Referring to FIGS. 2 and 3, earth metal fittings 4 are press-worked elastic metal plate formed to be cylindrical. The earth metal fittings 4 include a cylindrical part 17 which is C-shaped in sectional view and a pressurized barrel part 15 which is U-shaped in sectional view. The pressurized barrel part 15 is connected to the cylindrical part 17 by the joint 14. This cylindrical part 17 has an axial slit 12. An engaged piece 16 is formed by cutting the cylindrical part 17. On the rear of the cylindrical part 17, four bosses 18 protrude, and are arranged at equal intervals along the periphery. A square hole 13 is provided in the middle of the slit 12. The joint 14 which connects the cylindrical part 17 and pressurized barrel part 15 has the same axis.

Figure 5:
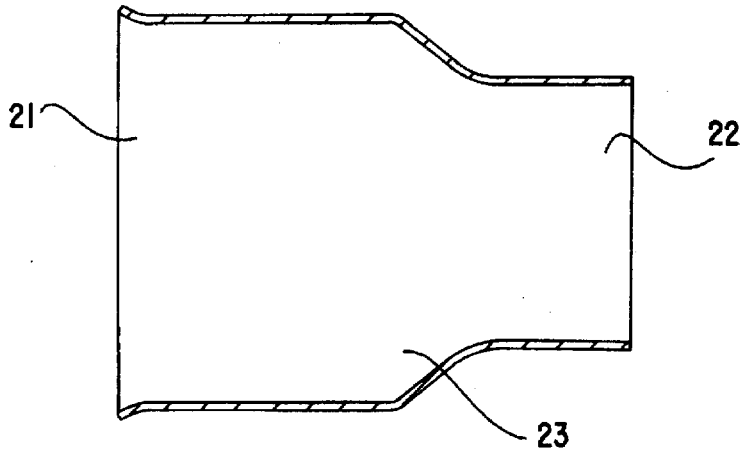
FIG. 5 shows a sectional view taken along the line 5—5 in FIG. 4.
Figure 4:
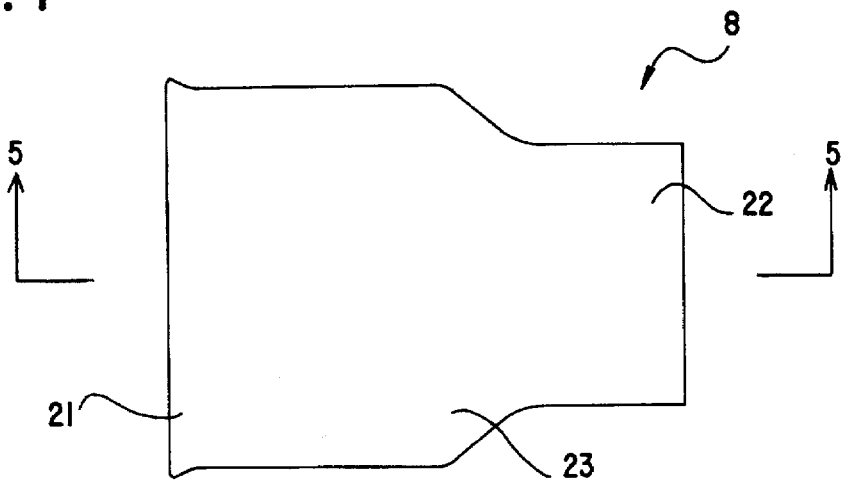
FIG. 4 is a front view of a shielding cylinder.

Referring to FIGS. 4 and 5, a shielding cylinder 8 is shown which includes a large diametric part 21, a small diametric part 22 and a slope 23.

Referring to FIG. 1, a molding cover 9 is provided on the periphery of the earth metal fittings 4. Engaged slope part 36 is provided on the inner surface of the molding cover 9. The engaged slope part 36 is attached to the engaged piece 16 of earth metal fittings 4 to prevent earth metal fittings 4 from moving forward.

Figure 6:
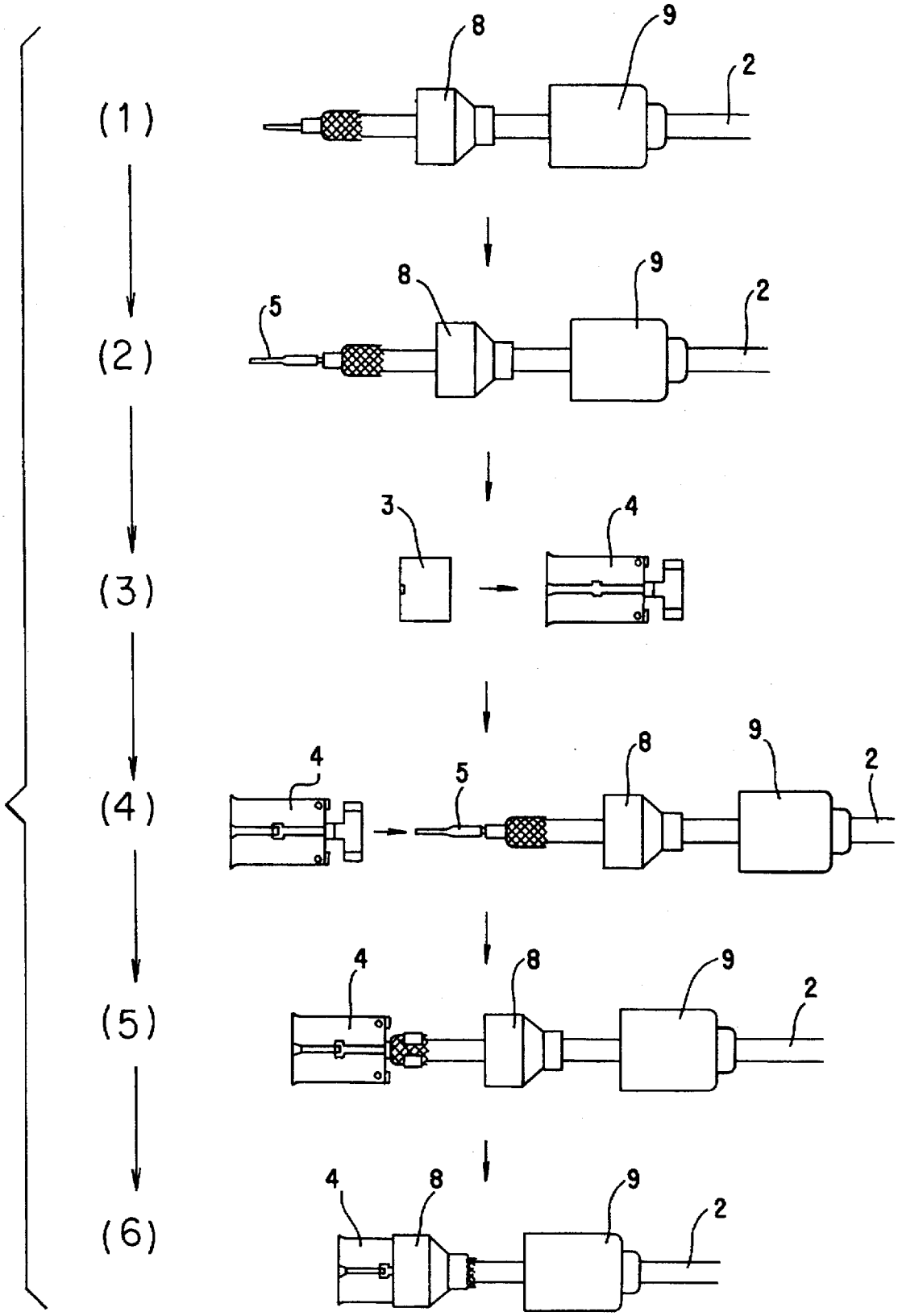
FIG. 6 illustrates the build-up process of the co-axial connector for a high-frequency cable of the present invention.
Figure 7:
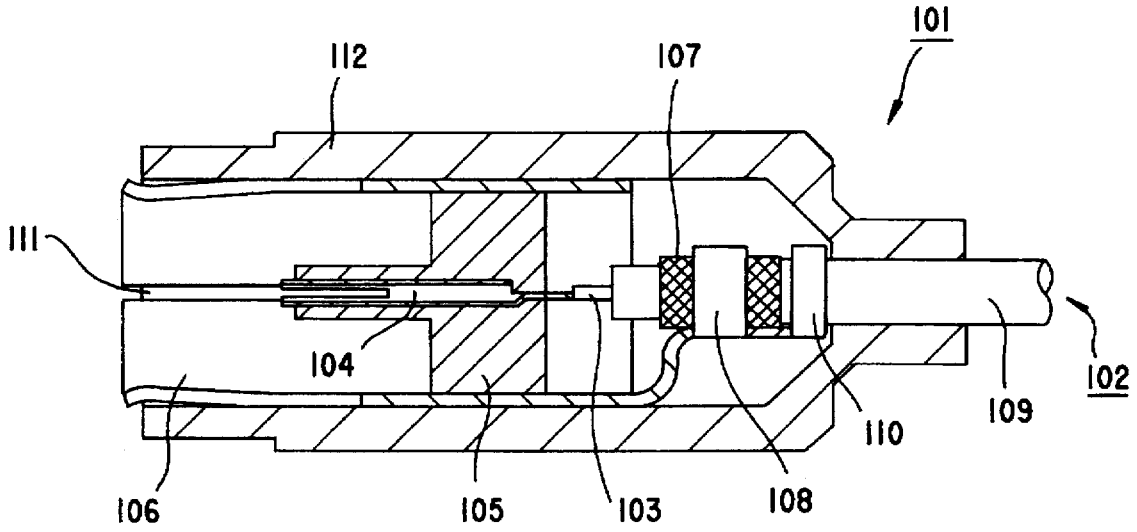
FIG. 7 is a sectional view of a prior art co-axial connector for a high-frequency cable.

The order of assembly of this co-axial connector 1 is explained by referring to FIG. 6. According to step 1, the end of the co-axial cable 2, is stripped to expose both a central conductor 6 and an external conductor 7. Then the external conductor 7 is folded back. Finally, the worked co-axial cable is inserted into both the molding cover 9 and a shielding cylinder 8 in turn.

Next, according to step 2, the central conductor 6 of a co-axial cable 2 is inserted into an insertion slot 39 of the center pin 5. After that, supporting part 29 is caulked to adhere to the center pin 5 to the central conductor 6. The caulking of the central conductor 6 and the center pin 5 does not always result in good adhesion, in which case, the central conductor 6 may be soldered to the center pin 5.

Next, according to step 3, an insulating bushing 3 is inserted into earth metal fittings 4 against its spring tension (from the front of the earth metal fittings 4). The engaging projection 10 is engaged with a square hole 13 where the projection 10 comes to the square hole 13. The insulating bushing 3 is sustained by engagement with the earth metal fittings 4.

Next, according to step 4, the center pin 5 is inserted into the center pin's hole 11 of an insulating bushing 3 from the rear of the insulating bushing until flange part 31 attaches to steps 40. At that time, pressurized barrel part 15 is located on the folded-back external conductor 7 of the co-axial cable 2.

Next, according to step 5, pressurized barrel part 15 is caulked.

Next, according to step 6, the shielding cylinder 8, which was previously inserted into the co-axial cable 2 in process (1), is covered so that the large diametric part 21 veils the rear of the earth metal fittings 4, and the small diametric part 22 might veil the pressurized barrel part 15. Then, the small diametric part 22 is caulked and connected to the pressurized barrel part 15, both electrically and mechanically. At this time, bosses 18 of the earth metal fittings 4 are attached to the inner surface of the large diametric part 21, and a cylindrical part 17 is connected to a shielding cylinder 8 by rigid-engagement, both electrically and mechanically.

Finally, the molding cover 9, which was previously inserted by a co-axial cable 2, covers the earth metal fittings 4. Backward slip-prevention is accomplished by attaching both the engaged part 16 and the engaging projection 10 to the slope part 36. On the other hand, forward slip-prevention is accomplished by attaching the inner wall of the molding cover 9 to the slope 23 of the shielding cylinder 8.

When you insert other connectors into the co-axial connector for a high-frequency cable assembled in this way from the front direction, the earth metal fittings 4 will be widened outside by elastic deformation. Thus, the co-axial connector becomes capable of being inserted by the other connectors which enables the co-axial connector to have the appropriate engaging force.

The co-axial connector for a high-frequency cable develops a slit 12 from the front end of the earth metal fittings 4 to the rear end which enables an insulating bushing 3 to be inserted into the earth metal fittings 4 easily, and also make assembly convenient. Furthermore, as a shielding cylinder 8 covers the earth metal fittings 4 so as to veil the rear of the slit 12, the insulating bushing 3 is prevented from slipping off the earth metal fittings 4 by the widening the slit 12 while in use. It is also possible to prevent high-frequency signals from leaking through the slit 12.

According to the present invention, as the connection between the shielding cylinder 8 and the earth metal fittings 4 is done with rigid-engagement between several bosses 18 (provided to the earth metal fittings 4) and large diametric part 21, noise that affects high-frequency signals can be reduced. Reliance of contact characteristics is increased. Furthermore, as the shielding cylinder 8 is assembled only by rigid-engagement with the earth metal fittings 4, complicated work like caulking, etc. is not required and thus assembly is made easier.

The present invention is not limited to the examples described herein and further embodiments are possible. For example, the rigid-engagement bosses 18 lying between the earth metal firings 4 and a shielding cylinder 8, are not always necessary. If the slit 12 is not widened and both the earth metal firings 4 and the shielding cylinder 8 are connected electrically, bosses 18 may not be necessary and any configuration may be selected.

What is claimed is:

1. A co-axial connector for a high-frequency cable, comprising:

a center pin connected to a central conductor of a co-axial cable;

an insulating bushing supporting said center pin;

earth metal fittings having a cylindrical part which engages and supports said insulating bushing wherein said cylindrical part has an axial slit which is widened due to engagement with said insulating bushing supporting said center pin;

a barrel part connected to a rear portion of said earth metal fittings and securing an external conductor of said co-axial cable;

a molding cover located on said earth metal fittings' periphery; and a shielding cylinder having a large diametric part and a small diametric part is located between said molding cover and said earth metal fittings such that said large diametric part covers the rear of said axial slit of said cylindrical part and fastens said cylindrical part centripetally and said small diametric part covers said barrel part.

2. The co-axial connector for a high-frequency cable according to claim 1 wherein said small diametric part of said shielding cylinder is caulked and electrically connected to said barrel part.

3. The co-axial connector for a high-frequency cable according to claim 1 wherein bosses are provided on a contact-surface between said shielding cylinder and said earth metal fittings.

4. The co-axial connector for a high-frequency cable according to claim 1 wherein said insulating bushing is engaged with said earth metal fittings through an engaging projection and a square hole, said engaging projection being provided on said insulating bushing and said square hole being located in a middle portion of said slit.

* * * * *